US006078231A

United States Patent [19]

Pelkonen

[11] Patent Number: 6,078,231

[45] Date of Patent: Jun. 20, 2000

[54] HIGH FREQUENCY FILTER WITH A DIELECTRIC BOARD ELEMENT TO PROVIDE ELECTROMAGNETIC COUPLINGS

[75] Inventor: Jari Pelkonen, Tuomioja, Finland

[73] Assignee: Lk-Products Oy, Kempele, Finland

[21] Appl. No.: 09/020,130

[22] Filed: Feb. 6, 1998

[30] Foreign Application Priority Data

Feb. 7, 1997 [FI] Finland ..... 970525

[51] Int. Cl.[7] ..... H01P 1/202

[52] U.S. Cl. ..... 333/203; 333/206; 333/134

[58] Field of Search ..... 333/202, 206, 333/207, 222, 203

[56] References Cited

U.S. PATENT DOCUMENTS

| | | | |
|---|---|---|---|
| 4,342,969 | 8/1982 | Myers et al. | 333/33 |
| 4,342,972 | 8/1982 | Nishikawa et al. | 333/206 |
| 4,686,496 | 8/1987 | Syrett et al. | 333/202 |
| 4,703,291 | 10/1987 | Nishikawa et al. | 333/206 X |
| 5,196,813 | 3/1993 | Nakakubo | 333/206 |
| 5,389,903 | 2/1995 | Piirainen | 333/203 |

FOREIGN PATENT DOCUMENTS

| | | | |
|---|---|---|---|
| 0 571 094 A3 | 11/1993 | European Pat. Off. . | |
| 0 599 536 A1 | 6/1994 | European Pat. Off. . | |
| 94914 | 7/1995 | Finland . | |
| 98417 | 2/1997 | Finland . | |
| 2 213 670 | 8/1989 | United Kingdom . | |
| 2 263 363 | 7/1993 | United Kingdom . | |
| 2276276A | 9/1994 | United Kingdom | 333/207 |

*Primary Examiner*—Seungsook Ham
*Attorney, Agent, or Firm*—Darby & Darby

[57] ABSTRACT

A coaxial resonator filter (1', 50, 50', 50") comprises a dielectric boardlike element (11, 51, 51") and on its surface at least one electrically conductive element (17, 19, 20, 21, 52) to provide an electromagnetic coupling to at least one coaxial resonator (3, 53). The dielectric boardlike element may be the same as the filter's base plate, in which case its outer surface comprises a continuous earth plane (55), or it may be parallel to a separate electrically conductive base plate (56). Link (17), tap (19) and capacitive (20) coupling elements can be realized on the surface of the dielectric board.

16 Claims, 4 Drawing Sheets

HIGH FREQUENCY FILTER WITH A DIELECTRIC BOARD ELEMENT TO PROVIDE ELECTROMAGNETIC COUPLINGS

The present U.S. patent application claims priority from Finnish patent application No. 970525 filed Feb. 7, 1997.

The invention relates in general to radio-frequency filter structures. In particular the invention relates to coaxial resonator filters having an operating frequency higher than 2 GHz.

BACKGROUND OF THE INVENTION

A coaxial resonator filter according to the prior art comprises several coaxial resonators the electromagnetic couplings between which are realised by means of hole and link couplings. FIG. 1 shows a few prior art implementations for realising the couplings. A filter 1 comprises a base plate of a conductive material such as copper, coaxial resonators 3 and an electrically conductive casing 6 which encloses the resonators and includes electrically conductive walls 7 between the resonators. One end (so-called short-circuited end) of each coaxial resonator 3 is attached to the base plate 2 through which it is earthed, and the other end is open, thus constituting a quarter-wave resonator. The walls in the resonator casing may have coupling holes 8 for inter-resonator couplings. The holes are usually located near the short-circuited end of the resonator since the magnetic field and hence the inductive coupling is the strongest there. The size of the hole also affects the strength of the coupling.

The coaxial resonator as such is a resonator type known to a person skilled in the art, comprising a substantially straight inner conductor and an outer conductor coaxially around said inner conductor. The filter according to FIG. 1 has at the upper end of each inner conductor an expansion the function of which is to form a so-called impedance step, or a change of impedance along the longitudinal axis of the resonator. The inner conductors may also be made without said expansion. In FIG. 1, the casing 6 constitutes the outer conductor of each resonator, so it is customary to the call the resonators' inner conductors 3 resonators in short.

In the case depicted in FIG. 1, coupling to a resonator is realised by means of a so-called link coupling. There is beside each resonator a conductive element 4 and 5, which may be a strip, as in FIG. 1, or a wire. The conductive element is conductively attached from a given point to the base plate, being thereby earthed. The strength of the coupling can be determined by adjusting the distance between the strip and the resonator sideways and vertically. This affects the inductive coupling of the resonator. FIG. 1 shows two different ways of realising a link coupling. Strip 5 is a conductive strip shaped like an upside-down U, placed near the resonator. The desired coupling is achieved by shaping the strip and changing its distance from the resonator. The problem in this case has been accurate repeating of the attachment of the strip to the desired location in the manufacturing stage so that the assembly usually requires a lot of working time before the desired characteristics are achieved. It has been noticed that strip 4, which encircles the resonator, can be more easily assembled and repeated than strip 5. However, even this link coupling takes a lot of inspecting and fine-tuning so it is not very well suited to mass production.

Another alternative method of forming the resonator coupling is so-called tapping wherein a conductive strip or wire is brought into contact with the resonator at a given location. The tapping determines the input impedance "seen" by the line to be connected in the direction of the resonator and the correct tapping point can be determined by means of either experimentation or calculation. Since the tapping is fixed, its successful realisation requires that it can be made repeatable with a sufficient accuracy as the strength of the coupling cannot be adjusted after the tapping has been completed.

Use of link couplings and tapping is known from the helix filter technology. For example, FI patent no. 95516 discloses the use of a conductive strip element to produce a link coupling. In addition, said patent describes a link element adjustment that can affect the strength of the coupling. Tapping of a helix resonator is known e.g. from FI patent no. 80542. Helix resonators are usually intended for lower frequencies (say, 450 or 900 MHz) than coaxial resonators, so the layout accuracy is not as critical as in coaxial resonator applications. With higher frequencies, the size of resonator structures gets smaller and thus the required mechanical manufacturing accuracy becomes more demanding.

The problem with the link coupling has been the positioning of the strip. In series production it has not been possible to assemble the strips repeatedly such that the link coupling be identical in all filters, but every filter has to be inspected and adjusted to the desired values by bending the link, usually manually. This increases manufacturing costs and slows down the manufacturing process. Since the aforementioned problems have occurred in conjunction with the link coupling, it has in practice been nearly impossible to implement tapping in the production of coaxial resonator filters in the traditional ways because finding the correct tapping point has been difficult because of the degree of accuracy required in the positioning and soldering.

The use of different couplings (link couplings, tappings, capacitive couplings) as such is kwown in filter technology, but their practical implementations have been in part difficult to realise and manage, especially in coaxial resonator filters.

SUMMARY OF THE INVENTION

An object of this invention is to provide a filter structure which eliminates the aforementioned disadvantages typical to the prior art, which makes the filter structure simpler and more advantageous to manufacture.

The objects of the invention are achieved by manufacturing the resonator coupling elements on the surface of a layer of an insulating material on the base plate or corresponding board.

The high-frequency filter according to the invention is characterised in that it comprises a dielectric boardlike element and on its surface at least one electrically conductive element to provide an electromagnetic coupling to at least one coaxial resonator.

The invention is based on the perception that in a filter structure comprising coaxial resonators a metal base plate can be substituted or supplemented by a dielectric board on the surface of which conductive patterns may be formed in a known manner. For example, striplike conductive elements formed on a printed circuit board or other insulating material using photolithography are repeated very accurately in the manufacturing process. A continuous earth plane can be formed on the other side of the dielectric board so that a separate metal base plate is not needed. On the other hand, the dielectric board which has conductive elements on its surface to provide coupling to the resonators can also be located at a desired distance from a separate base plate if the coupling has to be located at a certain height along the longitudinal axes of the resonators. According to the invention, the inter-resonator couplings in a coaxial resonator filter can be realised using link, tap or capacitive couplings, depending on the characteristics required.

Compared to separate conductive strips or wires, insulating boards and conductive elements formed on their surfaces are easily and accurately handled in the manufacturing process and their handling can be easily automated. The total number of structural elements in the filter is reduced, which improves its operating reliability and decreases the manufacturing costs. In addition to the link couplings used so far, also capacitive and tapping couplings can be employed, which means more versatile design options.

The invention is described in greater detail with reference to the preferred embodiments presented by way of example and to the attached drawing, in which

DETAILED DESCRIPTION OF ILLUSTRATIVE EMBODIMENTS OF THE INVENTION

Figure 1:
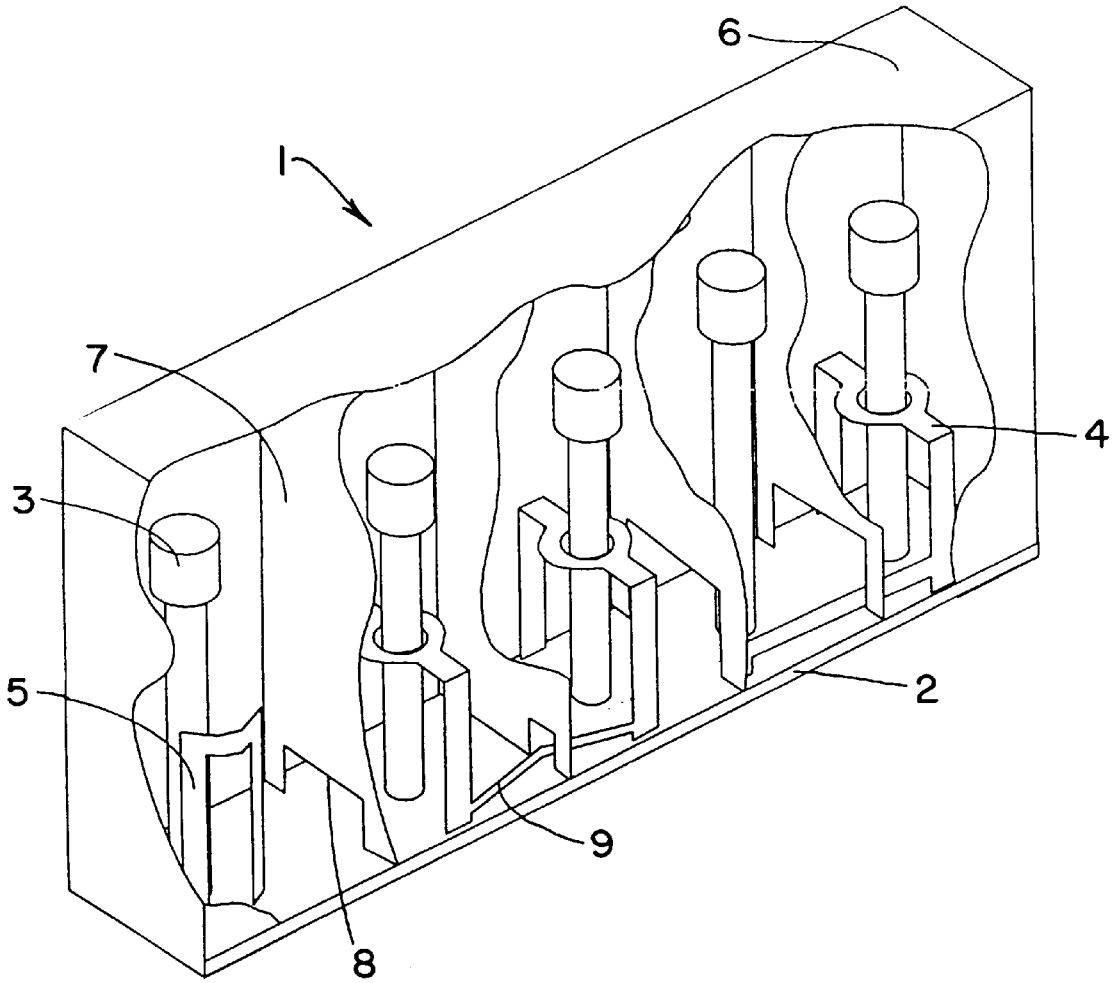
FIG. 1 PRIOR ART
FIG. 1 shows a coaxial resonator filter according to the prior art.

Above, in connection with the description of the prior art, reference was made to FIG. 1, so below in the description of the invention and its preferred embodiments reference will be made mainly to FIGS. 2 to 5*c*. Like elements in the drawing are denoted by like reference designators.

Figure 2:
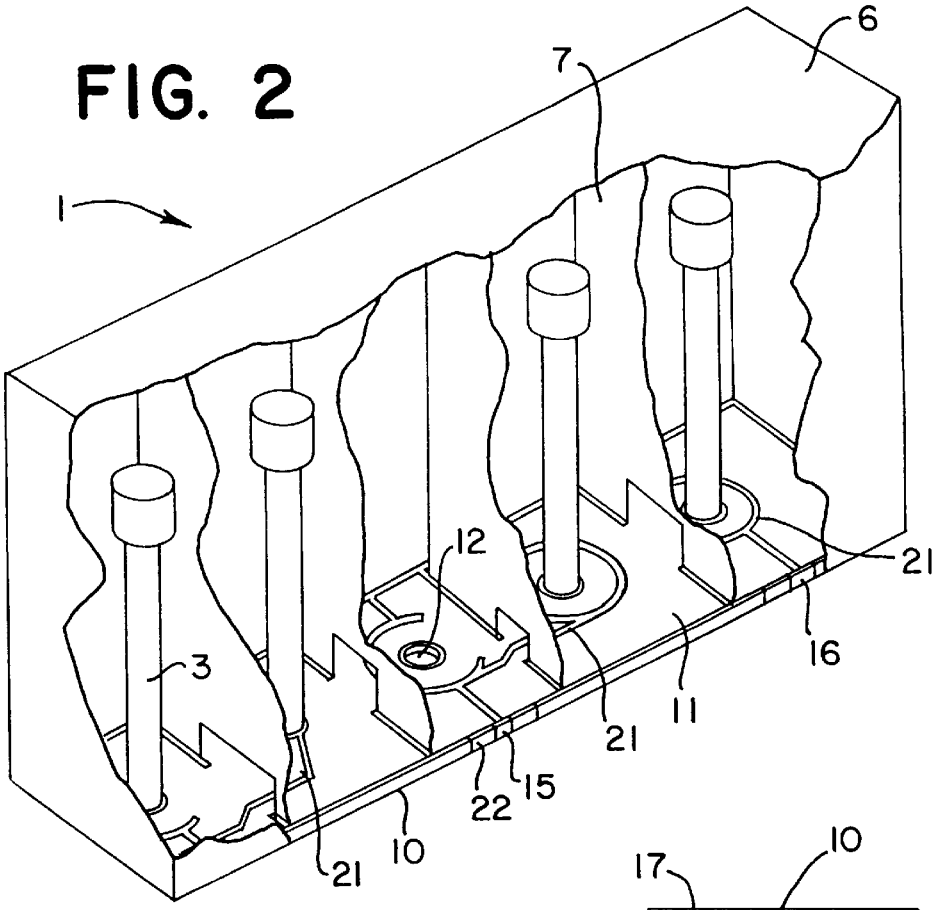
FIG. 2 shows a coaxial resonator filter according to a preferred embodiment of the invention.

FIG. 2 is an axonometric projection showing a coaxial resonator filter 1' according to a preferred embodiment of the invention. For illustrative purposes, part of the electrically conductive casing 6 around the filter is cut out in the drawing. Walls 7 divide the casing 6 into compartments in the same way as in filters of the prior art. In this illustrative embodiment there are five compartments, and in every compartment of a completed filter there is one inner conductor 3 of a coaxial resonator, which as such belongs to the prior art and is customarily called a resonator. In FIG. 2, the resonator in the middle compartment is not shown so as to illustrate an arrangement to attach the resonators. In the lower parts of the walls 7 there are holes the meaning of which is discussed later on. At the edge of the casing 6 there may be holes that isolate the casing from port strips 15 and 16 the meaning of which is discussed later on.

In FIG. 2, the filter base plate 11 is a printed circuit board the base material of which is a dielectric material (say, FR-4, CEM1, CEM3 or Teflon, which are brand names of known dielectric materials) such that electrically conductive areas of desired shapes and sizes can be formed by means of a known method on both surfaces and on all edges of the printed circuit board. The surface of the base plate 11 shown in FIG. 2 which is perpendicular to the orientation of the resonators 3 is called the top surface, and the surface parallel to it which is not shown in FIG. 2 is called the bottom surface. The names refer to the position of the filter shown in FIG. 2 and do not limit the manufacture or use of the filter in any particular direction. Conductive patterns 21, shown black, are formed on the top surface to provide coupling to the resonators 3 and an electromagnetic coupling between the resonators. On the bottom surface of the base plate 11 there is a substantially continuous electrically conductive coating (not shown) which constitutes an earth plane and is connected to a plating 10 on the edges of the base plate. Said plating has gaps 22 which separate the continuous plating from port strips 15 and 16. The port strips are narrow conductive areas on the edge of the printed circuit board which are connected to certain conductive patterns on the top surface of the printed circuit board 11 and thus to certain resonators. By means of the port strips the filter 1' is connected in a completed radio device to the other parts of said device, such as an antenna, transmit branch power amplifier and a receive branch low-noise pre-amplifier. In the electrically conductive coating on the bottom surface of the printed circuit board there is a hole (not shown) at each port strip lest there occur a short-circuit between the port strip and the earth plane. Instead of a completely continuous earth plane it is also possible to form on the bottom surface conductive patterns to which separate components may be attached. However, reducing the unity of the earth plane usually deteriorates the electromagnetic characteristics of the filter since electromagnetic energy then leaks outside the filter.

For the attachment of resonators 3 the printed circuit board 11 has at each resonator a hole 12 on the inner surface of which there is a metal plating or other electrically conductive coating connected to the electrically conductive coating, or the earth plane, on the bottom surface of the printed circuit board. The inner surface of the hole need not be metal plated if the electrical coupling to the resonator can be made reliable enough in some other way. To ensure the best possible electric contact and to realise accurate electromagnetic dimensioning each hole 12 is encircled by a ring of conductive coating also on the top surface of the printed circuit board. The invention does not define the method used for attaching the resonators to the printed circuit board, but any known method for attaching a small-sized conductive element to a printed circuit board is applicable. The resonators can be soldered to their places or attached using electrically conductive glue, for example. The invention only requires that the resonators are attached firmly and have a good enough electric contact to the earth plane at that end which faces the base plate. Making of holes the inner surfaces of which are plated is known from the manufacturing of ordinary two-sided printed circuit boards and multilayer printed circuit boards in which such holes are called vias.

Figure 3A:
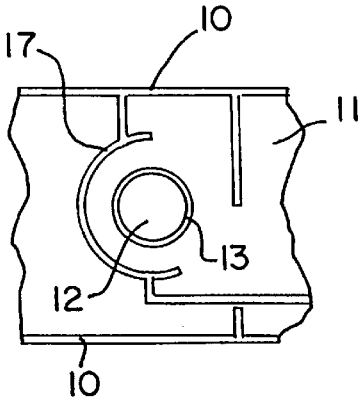
FIGS. 3*a* to 3*c* show different alternative coupling methods in the filter structure according to the invention.

FIGS. 3*a,* 3*b* and 3*c* show examples of different conductive patterns which are formed according to the invention on the surface of a printed circuit board 11 and which provide coupling to the resonators. In FIG. 3*a,* pattern 17 represents a link coupling wherein the pattern 17 encircles a resonator (here: a resonator's attachment hole 12) without a direct contact to it or to the ringlike conductive area that encircles it on the surface of the printed circuit board. In addition, the link coupling has to be connected from a certain point to the earth plane, which is realised e.g. in such a manner that the conductive pattern 17 is connected to a conductive area 10 on the edge of the printed circuit board as shown in FIG. 3*a*. The correct spot at which the conductive pattern 17 is connected to the earth plane can be determined by means of calculation or experimentation. The strength of the link coupling is determined by the distance between the conductive pattern 17 and the conductive ring 13 around the hole 12. The smaller the distance between the conductive pattern 17 and the conductive ring 13 around the hole 12, the stronger the link coupling and vice versa.

Figure 3B:
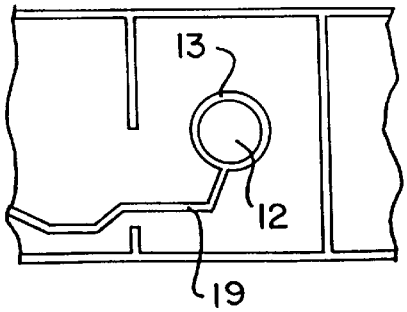

Pattern 19 in FIG. 3*b* represents a tapping in which the conductive pattern 19 is connected directly to a conductive area 13 encircling a hole 12 in the printed circuit board. In this case the strength of the tap coupling is determined on the basis of the length of the pattern 19 and the thickness of the printed circuit board 11. The distance between the tapping point and the short-circuited end of the resonator, measured along the longitudinal axis of the resonator, equals the thickness of the printed circuit board. Since the electrically conductive coating on the inner surface of the hole 12 is only a few micrometers thick, it does not substantially add to the thickness of the resonator in that part which penetrates the printed circuit board and, therefore, does not cause a noticeable impedance step at the level of the top surface of the printed circuit board along the longitudinal axis of the resonator. According to the invention, capacitive coupling can also be realised as depicted by pattern 20 in FIG. 3*c*. Therein, a conductive area 20 encircles the resonator (here: the resonator's attachment hole 12) without a direct contact to the earth plane or resonator. The strength of the capacitive coupling is determined on the basis of the distance between the ringlike conductive area 20 and the conductive ring around the hole 12 in the same way as described above with reference to link coupling.

Figure 3C:
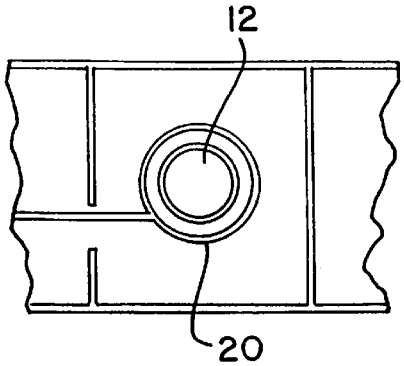
Figure 4:
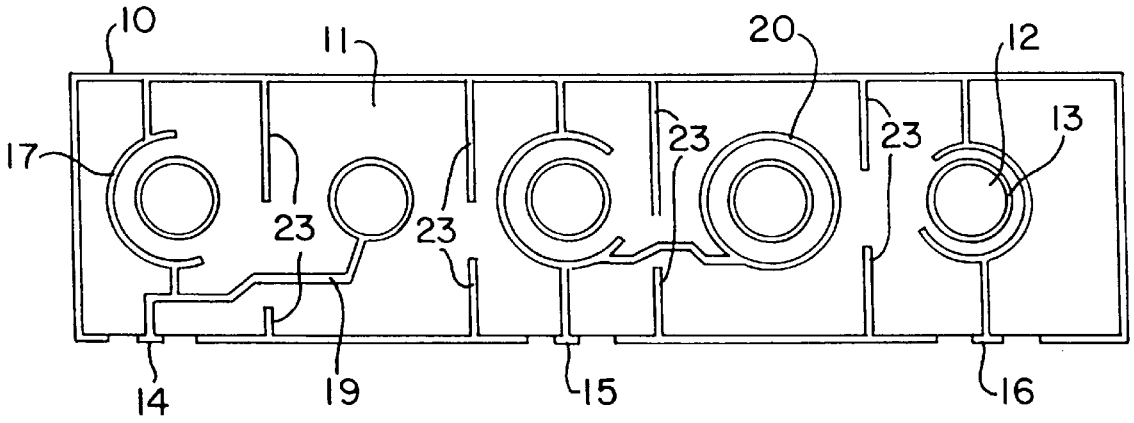
FIG. 4 shows by way of example a pattern on a dielectric board.

FIG. 4 shows a printed circuit board's top surface containing several couplings, including link, tap and capacitive couplings according to FIGS. 3*a* to 3*c*. The figure also shows a conductive coating 10 along the edge of the printed circuit board and port strips 14, 15 and 16 in the gaps of said coating. Tap coupling 19 extends to the left in the figure so that it is connected to both the link coupling 17 and port strip 14. Also the link coupling partly encircling the middlemost resonator hole and the capacitive coupling ring 20 encircling the adjacent hole to the right are in direct galvanic contact with each other. Additionally, there is a connection from the link coupling of the middlemost resonator hole to port strip 15. The link coupling partly encircling the rightmost resonator hole 12 is connected to port strip 16. The printed circuit board according to FIG. 4 can be used to implement a duplex filter for a two-way radio device, said duplex filter being connected via port strip 14 to a transmit branch power amplifier output port (not shown), via port strip 15 to an antenna (not shown) of the radio device and via port strip 16 to a receive branch low-noise pre-amplifier input port (not shown).

The straight conductor strips 23 that extend towards each other from the edges of the printed circuit board 11 are intended for creating a contact between the printed circuit board 11 and the lower edges of the walls in the filter casing. The gaps are illustrated mainly in FIG. 2. At the pcb-side end of a wall there may be a small gap the main purpose of which is to isolate the wall from the coupling pattern extending from resonator to resonator. Then the straight conductor strip formed on the surface of the printed circuit board for the lower edge of the wall is interrupted so that its ends come relatively near to the coupling pattern extending from resonator to resonator as in FIG. 4 between the middlemost resonator and the resonator closest to it on the right. The wall may also have a hole to only provide an electromagnetic coupling between adjacent resonators so that on the surface of the printed circuit board the corresponding conductor strip is "cut" even if there is no inter-resonator conductor strip at that location. This is illustrated in FIG. 4 by the conductor strip 23 between the middlemost resonator and the resonator adjacent to it on the left as well as by the conductor strip 23 between the two rightmost resonators. A gap in a wall may also have both aforementioned functions so that the gap often is bigger than what is required just for isolating the wall from the inter-resonator conductor strip on the surface of the printed circuit board. This is illustrated in FIG. 4 by the arrangement between the two leftmost resonators. If a wall does not have a gap at all, the corresponding conductor strip can naturally extend from one edge of the printed circuit board to the other uninterrupted on the surface of the printed circuit board. In some cases it may be advantageous to arrange an electric contact between the inter-resonator coupling pattern and the conductive pattern formed for the lower edge of a wall.

It is obvious that the shapes and dimensions of the coupling patterns formed on the surface of the printed circuit board 11 according to FIGS. 3*a* to 3*c* and 4 are presented by way of example only and do not limit the invention. Both on the basis of theoretical analysis and by means of practical experimentation it is possible to provide conductive patterns that have different shapes and dimensions and that realise desired inter-resonator couplings as well as couplings between the resonators and port strips. The number and functions of the port strips may vary. Solder pads can also be formed on the top and/or bottom surface of the printed circuit board, and separate components such as resistive, capacitive and inductive components as well as switching semiconductors such as PIN diodes can be connected to said pads. In some cases it is advantageous to amplify the signal between the resonators, in which case a small-sized radio-frequency amplifier can be connected to the printed circuit board, and the voltage signals for said amplifier are brought to the structure via separate port strips. The separate components can be connected to the conductive patterns and earth plane on the surfaces of the printed circuit board in many different ways so that it is possible to realise e.g. switchable filters the frequency responses of which vary as a function of an electric control signal brought to them. The conductive patterns may also form geometric structures which have a passive shaping effect on the high-frequency signal travelling between the resonators or between the resonators and port strips. Such passively affecting geometric patterns include various known stripline structures to attenuate harmonic frequencies.

Figure 5A:
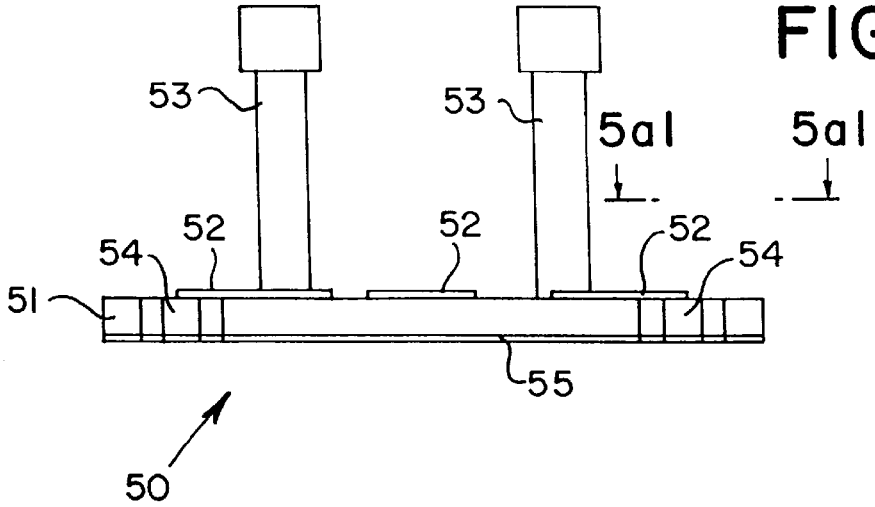
FIGS. 5*a* to 5*c* show different embodiments of the invention.
Figure 5A:
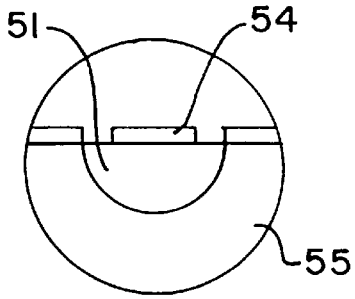

FIGS. 5*a,* 5*b* and 5*c* are side views (without the casing) of different embodiments for realising a radio-frequency filter according to the invention. All these embodiments share the inventional idea that coupling to the resonators of a coaxial resonator filter is realised via conductive patterns formed on the surface of a dielectric boardlike structural element. In the figures, the dielectric boardlike structural element is a printed circuit board and the thickness of the conductive patterns formed on its surface is exaggerated in the drawing so as to make them more discernible. The filter described by FIGS. 5*a,* 5*b* and 5*c* only has two resonators, which illustrates the fact that the invention does not set any limit to the number of resonators in the filter.

In FIG. 5*a,* the structure of the filter 50 corresponds to a great extent to that of the filter shown in FIG. 2. A printed circuit board 51 serves as a substrate for the filter. Conductive patterns 52 on the top surface of the printed circuit board realise the required couplings to the resonators 53 and also provide connections to port strips 54. On the bottom surface of the printed circuit board 51 there is a substantially continuous electrically conductive coating 55 which acts as an earth plane and is isolated from the ports strips 54 as shown in the detail on the right. The earth plane and the electrically conductive coating along the edge of the printed circuit board 51 are coloured grey to distinguish them from the conductive patterns 52 and port strips 54 which are coloured black. In the detail, the port strip and the area around it are viewed looking into the bottom of the filter. The structure according to FIG. 5*a* can be modified so as to disclose a structure wherein the printed circuit board 51 is a multilayer printed circuit board having conductive patterns according to FIG. 5*a* on its top surface, a continuous earth plane on one of its intermediate layers, and possibly more conductive patterns or separate components on its bottom surface.

Figure 5B:
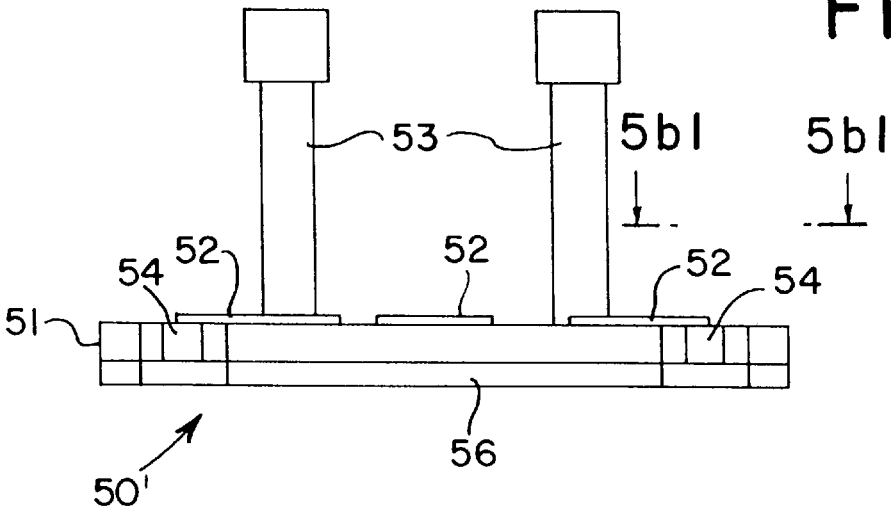

In FIG. 5*b* the structure of the filter 50' is otherwise identical to that shown in FIG. 5*a,* but instead of (or in addition to) the coating on the bottom surface of the printed circuit board 51 the earth plane is formed by a separate plate 56 made of an electrically conductive material. The invention does not define the method used for attaching the plate to the rest of the filter. The plate 56 may have holes for the attachment of resonators in the same way as the printed circuit board 51 or it may by continuous, in which case the resonators are attached to the top surface of the plate 56. The plate 56 is isolated from the port strips in the same manner as described in the detail of FIG. 5*a* for the coating of the bottom surface of the printed circuit board or in some other way. In the embodiments of both FIG. 5*a* and FIG. 5*b* the distance of the conductive patterns on the top surface of the printed circuit board 51 from the earth plane depends on the thickness of the printed circuit board. Said distance has some effect on the filter's electrical characteristics and a suitable printed circuit board thickness can be found through experimentation. Naturally, a second printed circuit board can be added under the base plate 56 in the structure shown in FIG. 5*b* which can be used to realise separate components or other couplings affecting the operation of the filter.

Figure 5C:
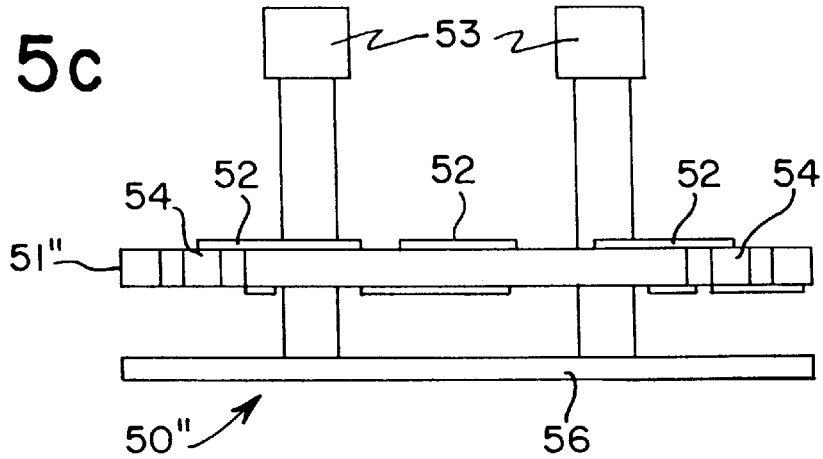
Figure 5C:
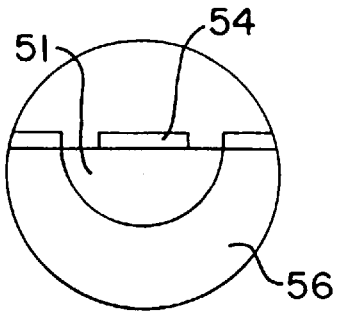

FIG. 5*c* shows a somewhat different structural arrangement for realising the filter 50". Therein, the base plate 56 in the lower part of the filter is not directly connected to the printed circuit board 51", but there is an air gap between them. In this embodiment, the conductive patterns formed on the surface of the printed circuit board 51" are located as far away as possible from the earth plane, which can be advantageous in some applications of the invention. Additionally, the printed circuit board 51" may have conductive patterns (and separate components, among other things) on its top and bottom surfaces. A suitable distance between the printed circuit board 51" and the base plate 56 can be found by means of experimentation. The printed circuit board may be located at any height along the longitudinal axis of the resonators. If the printed circuit board is located farther away from the base plate than the length of the longest resonator, it need not even have holes for the resonators. If the base plate 56 is metal as in FIG. 5*c,* it constitutes an earth plane by nature. An embodiment can be disclosed which is otherwise like that shown in FIG. 5*c* except that the base plate constitutes a printed circuit board so that there may be conductive patterns and separate components on its top surface and a continuous earth plane on its bottom surface.

The embodiments described above by way of example can be modified within the scope of the invention defined by the claims set forth below. The number, shape or location of the resonators is not limited. The filter can be formed using only one of the couplings described or combinations of the couplings. Dimensions and details of the structure are chosen according to the frequency response required. The term "printed circuit board" used in the description for simplicity covers all dielectric, substantially boardlike pieces on the surface of which electrically conductive patterns may be formed.

I claim:

1. A high-frequency filter comprising:

a first coaxial resonator including a first inner conductor and a first outer conductor;

a second coaxial resonator including a second inner conductor and a second outer conductor, each of said first and second coaxial resonators including a top end and a short circuited bottom end, and an air gap existing between each said respective inner and outer conductors;

a base plate attached to the short circuited bottom ends of said first and second coaxial resonators;

a dielectric board including a first hole and a second hole therethrough; and at least one electrically conductive element on a surface of said dielectric board to provide an electromagnetic coupling to at least one of said first and said second coaxial resonators, wherein said first inner conductor extends through said first hole, said second inner conductor extends through said second hole and said dielectric board is located at a distance in the direction toward the base plate from said top end of said at least one of said first and second coaxial resonators to which said dielectric board is coupled.

2. The high-frequency filter of claim 1 wherein the edges of each hole in the dielectric board have an electrically conductive coating.

3. The high-frequency filter of claim 1 wherein said high-frequency filter has a generally rectangular prism shape and comprises as one of its sides said base plate, and said dielectric board is integral with said base plate.

4. The high-frequency filter of claim 3, wherein said at least one electrically conductive element is located on a first surface of said base plate, and a second surface of said base plate, which is also the outer surface of the filter, comprises a substantially continuous electrically conductive layer.

5. The high-frequency filter of claim 1, wherein said filter is shaped like a rectangular prism and comprises as one of its sides said base plate, said base plate being electrically conductive, and said dielectric board is parallel to said base plate.

6. The high-frequency filter of claim 5, wherein said dielectric board and said base plate are located one immediately on top of the other constituting a continuous board structure.

7. The high-frequency filter of claim 5, wherein said dielectric board and said base plate are separated from each other.

8. The high-frequency filter of claim 1, wherein said at least one electrically conductive element is a link coupling element which is in direct galvanic contact with the outer conductors of the coaxial resonators and which is not in direct galvanic contact with the inner conductor of the coaxial resonator to which it makes an electromagnetic coupling.

9. The high-frequency filter of claim 1, wherein said at least one electrically conductive element is a tap coupling element which is in direct galvanic contact with the inner conductor of the coaxial resonator to-which it makes an electromagnetic coupling and which is not in direct galvanic contact with the outer conductors of the coaxial resonators.

10. The high-frequency filter of claim 1, wherein said at least one electrically conductive element is a capacitive coupling element which is not in direct galvanic contact with the inner conductor of the coaxial resonator to which it makes an electromagnetic coupling and which is not in direct galvanic contact with the outer conductors of the coaxial resonators.

11. The high-frequency filter of claim 1, wherein said at least one electrically conductive element extends to the vicinity of said first inner conductor and said second inner conductor to provide an electromagnetic coupling between said first coaxial resonator and said second coaxial resonator.

12. The high-frequency filter of claim 1, wherein the filter comprises at the edge of said dielectric board at least one port strip to provide a coupling between said at least one electrically conductive element and an electric structural part outside the filter.

13. The high-frequency filter of claim 1, further comprising on the surface of said dielectric board at least one separate component to affect the frequency response of the filter.

14. The high-frequency filter of claim 1, wherein said at least one electrically conductive element comprises a certain geometric shape which affects the frequency response of the filter.

15. A duplex filter for filtering a transmitting and receiving signal in a radio apparatus in which the transmission and reception occur via one and the same antenna, comprising:

at least a first coaxial resonator including a first inner conductor and a first outer conductor, and a second coaxial resonator including a second inner conductor and a second outer conductor, each of said first and second coaxial resonators including a top end and a short circuited bottom end;

a base plate attached to the short circuited bottom end of said first and second coaxial resonators;

a dielectric board including a first hole and a second hole there through; and at least one electrically conductive element on a surface of said dielectric board to provide an electromagnetic coupling to at least one of said first and said second coaxial resonators, wherein said first inner conductor extends through said first hole, said second inner conductor extends through said second hole and said dielectric board is located at a distance in the direction toward the base plate from said top end of said at least one of said first and second coaxial resonators to which said dielectric board is coupled.

16. The high-frequency filter of claim 1 wherein said base plate provides a short circuit at the bottom ends of said first and second coaxial resonators.

* * * * *